US005450947A

United States Patent [19]

Sgueglia, Sr.

[11] Patent Number: 5,450,947

[45] Date of Patent: Sep. 19, 1995

[54] CARTRIDGE BOX APPARATUS

[76] Inventor: John A. Sgueglia, Sr., 40 Butternut Rd., North Branford, Conn. 06471

[21] Appl. No.: 311,882

[22] Filed: Sep. 26, 1994

Related U.S. Application Data

[63] Continuation of Ser. No. 110,015, Aug. 23, 1993, abandoned.

[51] Int. Cl.[6] ..... B65D 85/20

[52] U.S. Cl. ..... 206/3; 206/446; 206/499; 206/564

[58] Field of Search ..... 206/3, 443, 446, 499, 206/564, 587; 224/194, 230, 252, 253; 220/606

[56] References Cited

U.S. PATENT DOCUMENTS

| | | | |
|---|---|---|---|
| 869,310 | 10/1907 | Lemly | 224/253 |
| 1,455,803 | 5/1923 | Nofsinger | 206/3 |
| 1,894,873 | 1/1933 | Johnson | 206/3 |
| 2,305,198 | 12/1942 | Shonblom | 206/3 |
| 2,396,184 | 3/1946 | Lima | 206/3 |
| 3,163,286 | 12/1964 | Covington, Jr. | 206/3 |
| 3,756,387 | 9/1973 | Chaney | 206/3 |
| 3,769,733 | 11/1973 | Nelson | 224/253 |
| 3,923,152 | 12/1975 | Minneman | 206/3 |
| 4,194,657 | 3/1980 | Thor | 224/252 |
| 4,757,894 | 7/1988 | Schreckenstein | 206/3 |

*Primary Examiner*—Jimmy G. Foster

[57] ABSTRACT

A new and improved cartridge box apparatus for storing a number of cartridges includes a plurality of walls which define a storage space and a first opening for receipt and removal of cartridges from the storage space. In a first preferred embodiment, the cartridge boa is suited for cooperation with the vest or pouch on a shooter's jacket. In a second, alternatively preferred embodiment, the cartridge storage apparatus includes means for ejecting a cartridge from the side of the storage space and inserting a spent shell in the top of the storage space. In addition, means are disclosed for conveniently mounting the apparatus on a belt worn by the shooter.

5 Claims, 4 Drawing Sheets

CARTRIDGE BOX APPARATUS

This application is a continuation of application Ser. No. 08/110,015, filed Aug. 23, 1993, now abandoned.

BACKGROUND OF THE INVENTION

1. Field of the Invention

The present invention relates generally to boxes for storing ammunition, and more particularly, to a cartridge box apparatus especially adapted to present individual loaded cartridges to the user.

2. Description of the Prior Art

Boxes for storing cartridges for hand guns, rifles, and shotguns are well known in the art. Generally, such boxes store original cartridges such as shot gun shells for example, in a multiplicity of horizontal rows in a cardboard container having a flip-top box lid. Such cardboard containers are relatively flimsy and are difficult to reuse especially when it is desired to store reloaded shells in the same box in which the original shells were purchased and before they were used. Reloaded shot gun shells commonly are used by skeet and trap shooters. The reloaded shells are repacked on a reloading bench with fresh powder and shot and the casing is resealed. The trap or skeet shooter then usually transports the reloaded shells to the shooting range in the cardboard container in which the original shells were purchased or loosely in the pockets of the shooter's clothing.

Generally, such loose storage often is not convenient for retrieving individual cartridges especially for a skeet or trap shooter where rapid and frequent loading of a shotgun is required. Moreover, as mentioned, the conventional cartridge boxes are generally made of cardboard or other paper product and are not durable. In view of the above considerations, it would be desirable if a cartridge box were provided that presents individual cartridges to the used in a horizontal orientation. Moreover, it would be desirable if a cartridge box were provided that is of durable construction, that is lightweight, and that stores and presents cartridges one at a time to the user.

A number of prior art ammunition boxes are known. For example, U.S. Pat. No. 3,974,739 of Bourlet discloses a box for storing belt ammunition wherein cartridges are stored in a horizontal orientation on a belt which is fed to a weapon.

U.S. Pat. No. 4,930,626 of Miller discloses a cartridge box which stores a plurality of separate cartridges in spaced apart relation to each other. A predetermined number of the cartridges and means are provided for moving the exposed cartridges into a position where they can be readily removed from the box without disturbing the remaining cartridges. The cartridge moving means includes a cartridge carrier that has a plurality of spaced apart openings that are inclined from the vertical (but not horizontal) so as to incline the cartridges and make them more readily accessible for removal.

U.S. Pat. No. 4,951,548 of Wixon et al discloses a complex apparatus and method for supply of belt-linked ammunition. U.S. Pat. No. Des. 284,714 of Thor discloses an ammunition box having a belt clip. U.S. Pat. No. Des. 312,173 of Smith et al discloses an ammunition box having a carrying handle and a lock for locking the box shut.

It is noted that although the prior art discussed above discloses ammunition boxes that store ammunition in a horizontal orientation, the ammunition that is stored horizontally is ammunition on a belt, whereby individual cartridges are connected to one another on the belt. However, the prior art discussed above does not disclose a cartridge box that stores and presents individual cartridges, that are not connected to one another on a belt, and that are in a horizontal orientation.

Another deficiency noted in prior art cartridge boxes is a lack of a storage area for used shells. Once a shell is spent, it would be desirable to retrieve the spent shell either to prevent fouling the environment with spent shells, or to permit the cartridge to be recycled. In this respect, it would be desirable if a cartridge box were provided that included a storage space for spent cartridge shells that are retrieved.

Thus, while the prior art described above indicates it to be well known to use boxes to store ammunition, the provision of simple and cost effective cartridge box is not contemplated that presents individual cartridges in a horizontal orientation. Nor does the prior art described above teach or suggest a cartridge box that is of durable construction, that is lightweight, and that stores and presents cartridges one at a time in a horizontal orientation to the user. In addition, the prior art does not disclose a cartridge box that would enable a user to store a spent shell as a new shell is used. The foregoing disadvantages are overcome by the unique cartridge box apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved cartridge box apparatus for storing a number of cartridges includes a plurality of walls which define a storage space and a first opening for receipt and removal of cartridges from the storage space. In a first preferred embodiment, the cartridge box is suited for cooperation with the vest or pouch on a shooter's jacket. In a second, alternatively preferred embodiment, the cartridge storage apparatus includes means for ejecting a cartridge from the side of the storage space and inserting a spent shell in the top of the storage space. In addition, means are disclosed for conveniently mounting the apparatus on a belt worn by the shooter.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved cartridge box apparatus which has all of the advantages of the prior art and none of the disadvantages.

It is another object of the present invention to provide a new and improved cartridge box apparatus which may be easily and efficiently manufactured and marketed.

It is a further object of the present invention to provide a new and improved cartridge box apparatus which is of durable and reliable construction.

An even further object of the present invention is to provide a new and improved cartridge box apparatus which is susceptible of a low cost of manufacture with regard to both materials and labor, and which accordingly is then susceptible of low prices of sale to the consuming public, thereby making such cartridge box apparatus available to the buying public.

Still yet a further object of the present invention is to provide a new and improved cartridge box apparatus that presents individual cartridges, that are not connected to one another on a belt, in a horizontal orientation.

Still another object of the present invention is to provide a new and improved cartridge box apparatus that is of durable construction, that is lightweight, and that stores and conveniently presents cartridges to the user.

Yet another object of the present invention is to provide a new and improved cartridge box apparatus that may be used in combination with a pouch on a shooter's vest.

Still yet another object of the present invention is to provide a new and improved cartridge box apparatus that which may be worn on a shooter's belt.

These together with still other objects of the invention, along with the various features of novelty which characterize the invention, are pointed out with particularity in the claims annexed to and form a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENTS

With reference to the drawings, a new and improved cartridge box apparatus embodying the principles and concepts of the present invention will be described.

Figure 1:
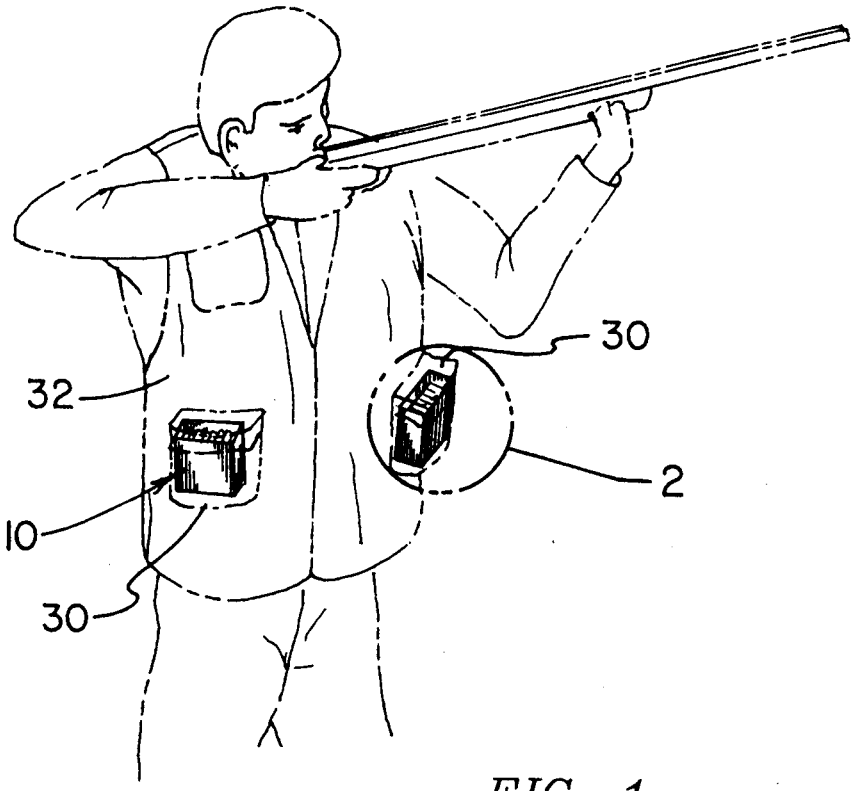
FIG. 1 is a perspective view in elevation showing a first preferred embodiment of the cartridge box apparatus of the invention in combination with a pouch on a shooter's vest.
Figure 2:
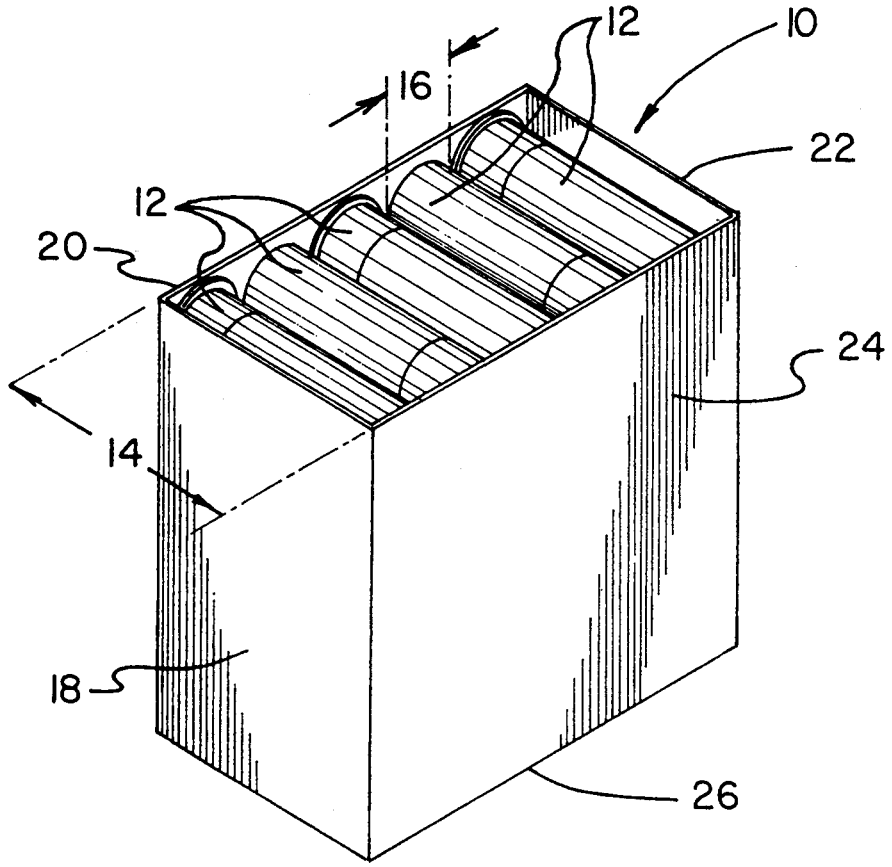
FIG. 2 is an enlarged perspective view of the embodiment of the cartridge box apparatus of the invention shown in FIG. 1 showing reloaded cartridges therein in horizontal rows.

Turning initially to FIGS. 1 and 2, there is shown a first exemplary embodiment of the cartridge box apparatus of the invention generally designated by reference numeral 10. In its first preferred and exemplary form, cartridge box apparatus 10 is designed for storing a number of cartridges 12 having a length 14 and a diameter 16. The cartridge diameter 16 is substantially less than the cartridge length 14. The cartridge box apparatus 10 of the invention includes a plurality of walls 18, 20, 22, and 24 and a floor 26 which define a storage space. The top of cartridge box apparatus 10 is open to define a receptacle for receipt and removal of cartridges 12 from the storage space. The walls 18, 20, 22, and 24 are dimensioned so that the storage space has a length which is slightly longer than the length of the cartridges 12. Also, the storage space has a width which is slightly wider than the diameter 16 of the cartridges 12. Also, the storage space has a height of sufficient magnitude to permit a number of cartridges 12 to be placed in a multiplicity of horizontal rows in the storage space as viewed in FIG. 2. It will be noted that the shells are oriented alternately from row to row.

Preferably, the walls and floor of cartridge box apparatus 10 are relatively rigid and of one-piece construction as by molding from a resinous material (e.g. PVC) to produce an inexpensive item of lightweight, durable material capable of being reused indefinitely for its intended purpose.

In use, the cartridge box apparatus 10 is filled with several rows of shotgun shells (FIG. 2). If desired, a reloader frame such as that made available under the trademark E-Z PAK by Mayville Engineering Co., Mayville, Ohio may be used to facilitate loading of cartridge box apparatus 10 in a simple and fast manner. The cartridge box apparatus 10 then is placed with its open top facing up in the pouch or pocket 30 of a shooter's vest 32 or other article of clothing as schematically depicted in FIG. 1. Easy access to and removal of the shells from the cartridge box apparatus 10 thus is facilitated in accordance with the present invention.

The cartridge box apparatus of the invention can be used with a variety of cartridges. It is particularly useful for containing shotgun shells. In this respect, it would useful if the cartridge box apparatus 10 would contain room for holding twenty-five cartridges. It is also particularly useful for cartridges used in skeet and trap shooting, and especially reloaded shotgun shells which often lack a suitable container.

Figure 3:
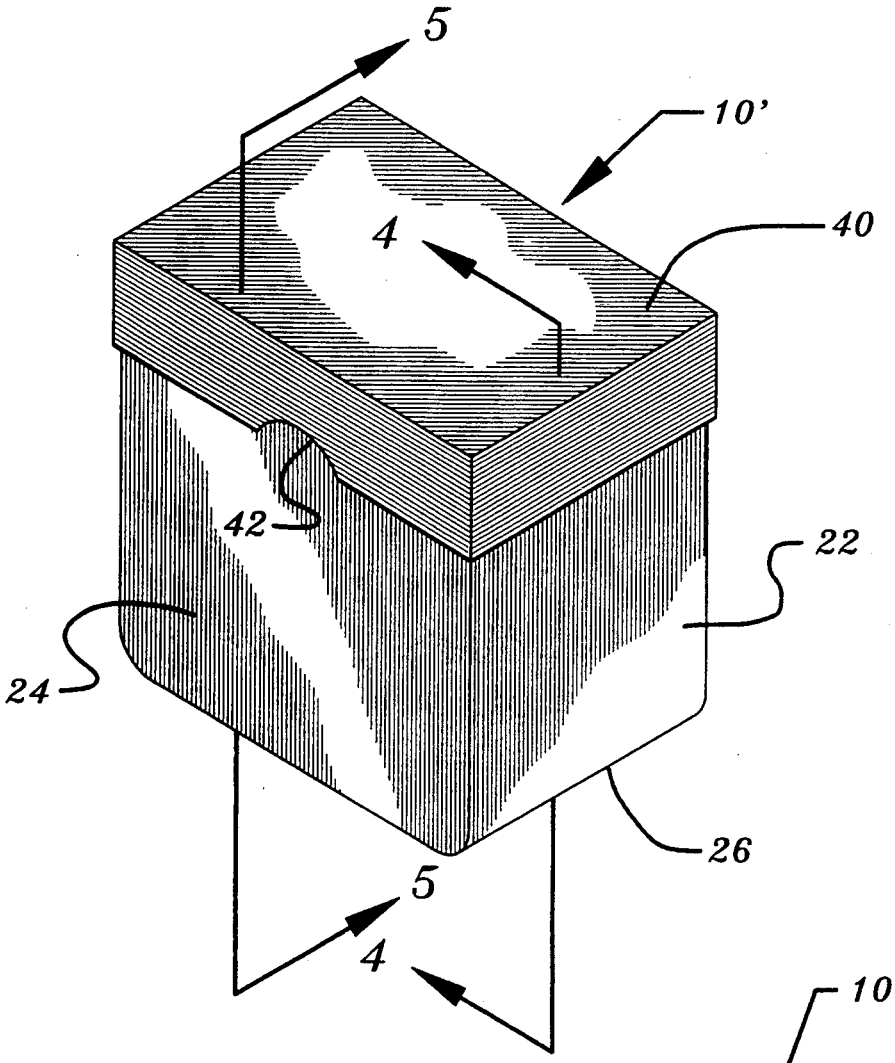
FIG. 3 is a perspective view of an alternatively preferred embodiment of cross-sectional view of the cartridge box apparatus of the invention.
Figure 4:
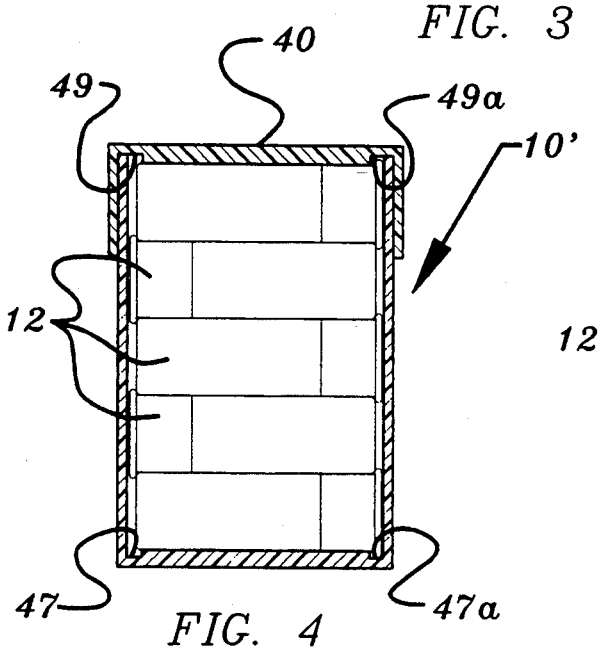
FIG. 4 is a cross-sectional view of the second preferred embodiment of the invention of FIG. 3 taken along line 4—4 thereof.
Figure 5:
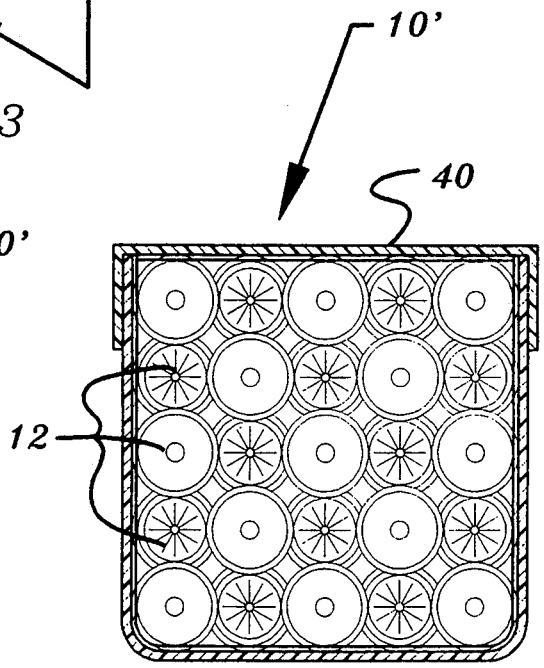
FIG. 5 is an elevational view of a third, alternatively preferred embodiment of the invention of FIG. 3 taken along line 5—5 thereof.

FIGS. 3 through 5 show a second, alternatively preferred embodiment of the invention generally designated by reference numeral 10'. In this modified version of the invention, a lid 40 is fitted to the open top of the cartridge box apparatus 10' to further protect the shells 12 stored therein. Lid 40 is shaped to conform to the shape of the cartridge box apparatus and is sized to peripherally and frictionally engage the upper portions of walls 18, 20, 22, and 24. An arcuate cutout 42 is disposed centrally in the edges of the opposed sidewalls of the lid (only one of which is shown in FIG. 3) to facilitate easy removal of the lid from the cartridge box apparatus 10' in a manner believed apparent.

Figure 6:
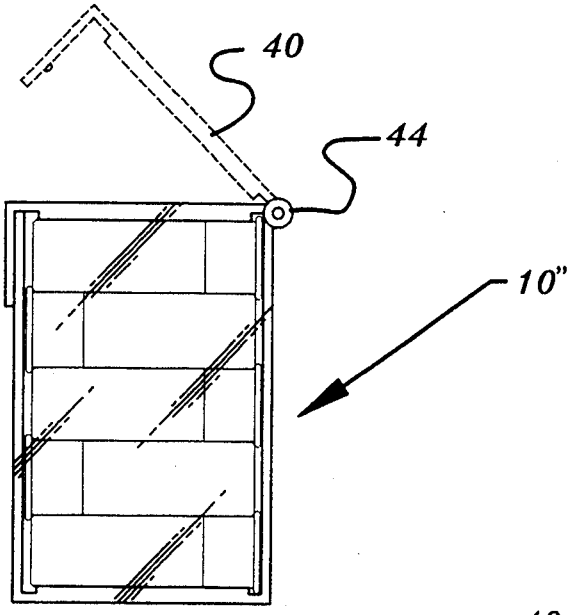
FIG. 6 is an elevational view of a third, preferred embodiment of the cartridge box apparatus of the invention showing a pivotal lid thereon.

FIG. 6 shows yet still another alternatively preferred version of the cartridge box apparatus of the invention wherein the lid 40' is connected to the cartridge box apparatus 10' by means of a pivotal connection 44 between the lid and the cartridge box apparatus.

Figure 7:
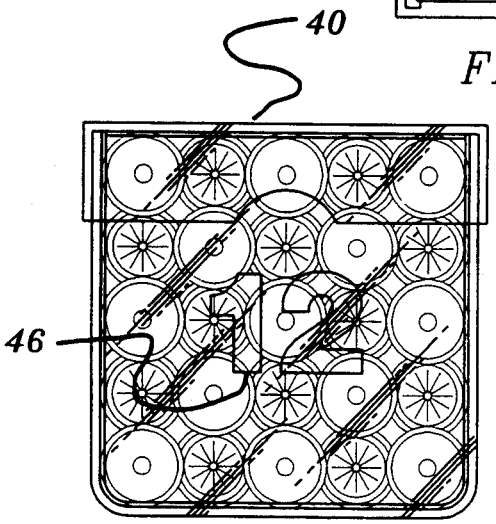
FIG. 7 is an elevational view of either the second or third embodiment of cartridge box apparatus of the invention showing reloaded shells of a first size stored therein in horizontal rows.
Figure 8:
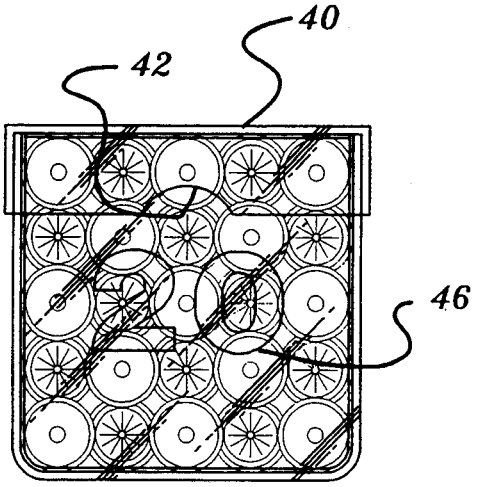
FIG. 8 is an elevational view of either the second or third embodiment of cartridge box apparatus of the invention showing reloaded shells of a second size stored therein in horizontal rows.
Figure 9:
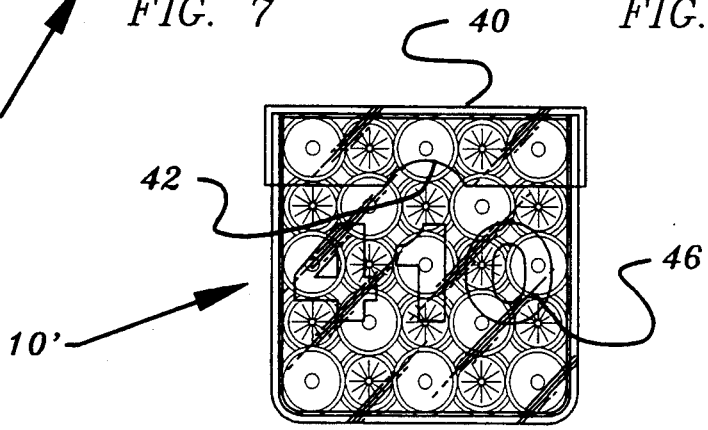
FIG. 9 is an elevational view of either the second or third embodiment of cartridge box apparatus of the invention showing reloaded shells of a third size stored therein in horizontal rows.

FIGS. 7 through 9 respectively show the cartridge box apparatus of the invention in different size formats to accommodate shotgun shells of corresponding different size. A suitable marking 46 may be placed on the outside surface of the cartridge box apparatus to indicate a particular size.

As shown in FIG. 4, a pair of spaced, parallel grooves 47, **47*a* in the upper surface of floor 26 extend along the larger dimension of the apparatus 10' substantially as shown to accommodate the rim on the individual shell's casing thereby permitting the alternately oriented rows of cartridges to lie horizontal within the storage space. A similar pair of spaced parallel grooves 49, 49*a* preferably are provided on the undersurface of lid 40** substantially as depicted in the drawings.

Figure 10:
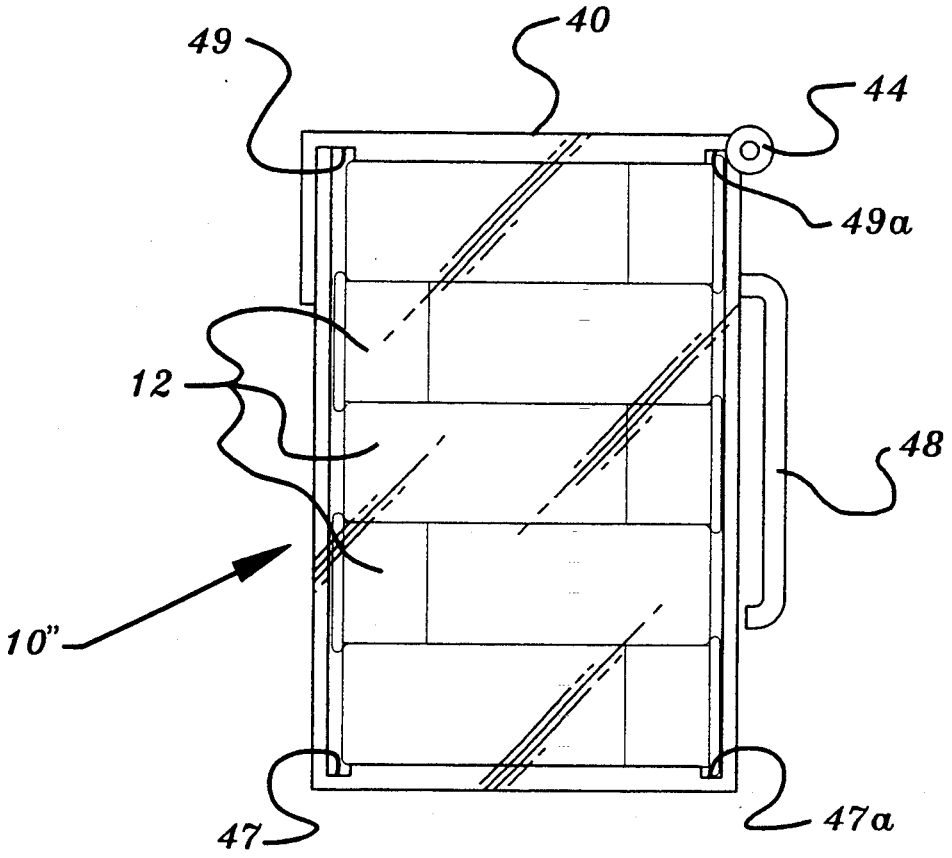
FIG. 10 is a side elevational view of an alternative embodiment of cartridge box apparatus of the invention showing reloaded shells of a second size stored therein in horizontal rows and being adapted to be removeably carried on a belt.
Figure 11:
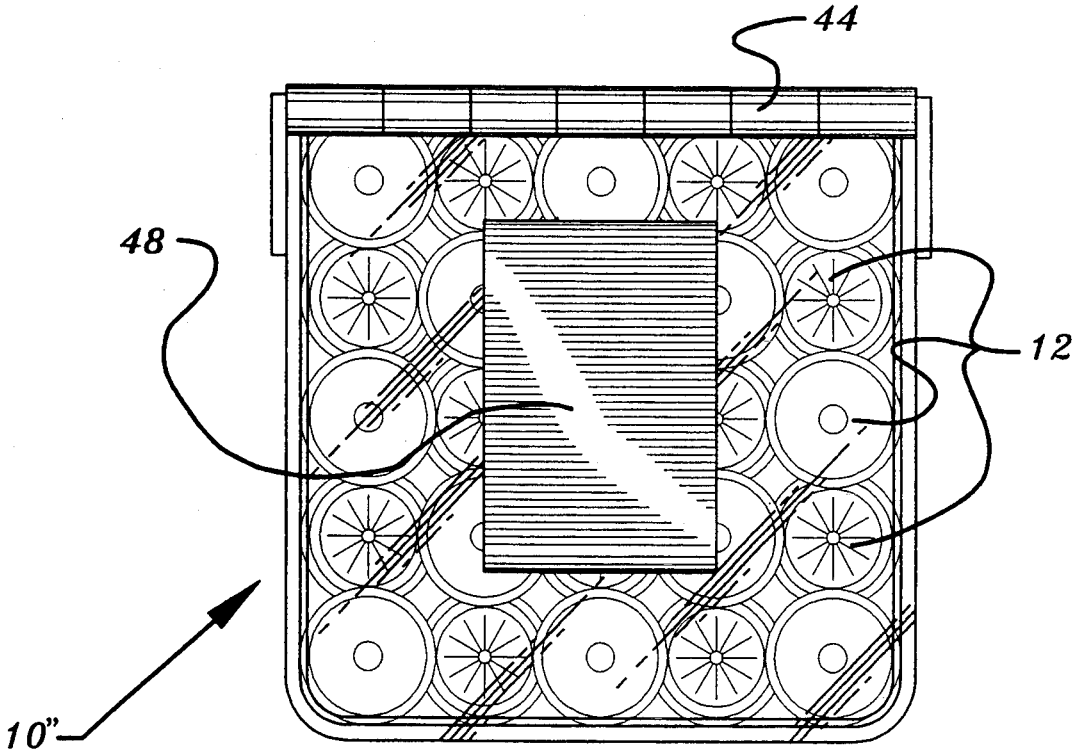
FIG. 11 is a rear elevational view of the alternative embodiment of the cartridge box apparatus of the invention shown in FIG. 10.

Turning now to FIGS. 10 and 11, there is shown a belt clip 48 attached to outside wall surface of the cartridge box apparatus 10 or 10' to facilitate mounting thereof on the shooter's belt in a manner believed apparent from the present disclosure.

It is apparent from the above that the present invention accomplishes all of the objects set forth by providing a new and improved cartridge box apparatus that is low in cost, relatively simple in design and operation, and which may advantageously be used to store loaded and spent cartridges.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A cartridge box apparatus for storing a number of cartridges each having a diameter, a longitudinal axis, and a rim at one end thereof, said cartridge box apparatus comprising:

a rectangular container defining an interior storage space, said rectangular container having first and second pairs of opposed walls extending orthogonally from a substantially flat base member, said first pair of walls comprising the long sides of said rectangular container and being spaced apart a first distance to accommodate a length of one of said cartridges, said second pair of walls comprising the short sides of said rectangular container and being spaced apart a second distance to accommodate a multiplicity of said cartridge diameters forming a row of said cartridges in said storage space, said first and second pairs of opposed walls having a height dimension above said base member sufficient to accommodate a multiplicity of said rows of said cartridges in said interior storage space one on top of the other with the axis of the cartridges in said rows being orthogonal to said first pair of opposed walls, said first and second pairs of walls terminating in an opening for said container spaced from said base member by said height dimension, wherein said base member defines an inside top surface upon which said multiplicity of rows of cartridges one on top of the other in said storage space is adapted to rest, said inside top surface having a pair of grooves recessed therein, each of said grooves extending parallel to and adjacent to a corresponding one of said first pair of opposed walls, respectively, whereby said rims on said cartridges may be stored in said storage space facing alternatively with respect to each other and said first pair of opposed walls, and wherein said box apparatus is sized to be received within a pocket on a shooter's vest.

2. The apparatus described in claim 1 wherein said cartridge box apparatus is of one-piece construction formed of a molded plastic material.

3. The apparatus described in claim 1, further including:

lid means, said lid means being adapted to fit over the top of said cartridge box apparatus to further protect the shells therein.

4. The apparatus described in claim 1, further including:

belt support means, said belt support means being attached to one of said plurality of walls.

5. The apparatus described in claim 1 wherein said storage space is large enough to receive a reloader rack filled with reloaded shells whereby said reloaded shells may be placed in said storage space by removing said reloader rack therefrom.

* * * * *